US009730562B2

(12) United States Patent
Yamada

(10) Patent No.: US 9,730,562 B2
(45) Date of Patent: Aug. 15, 2017

(54) WET WIPE PACKAGING BODY

(71) Applicant: Kikuo Yamada, Tokyo (JP)

(72) Inventor: Kikuo Yamada, Tokyo (JP)

( * ) Notice: Subject to any disclaimer, the term of this patent is extended or adjusted under 35 U.S.C. 154(b) by 0 days.

(21) Appl. No.: 14/894,880

(22) PCT Filed: Jun. 10, 2013

(86) PCT No.: PCT/JP2013/003637
§ 371 (c)(1),
(2) Date: Nov. 30, 2015

(87) PCT Pub. No.: WO2014/199409
PCT Pub. Date: Dec. 18, 2014

(65) Prior Publication Data

US 2016/0113450 A1 Apr. 28, 2016

(51) Int. Cl.

| | |
|---|---|
| ***A47K 10/32*** | (2006.01) |
| ***A47K 10/42*** | (2006.01) |
| ***B65D 75/58*** | (2006.01) |
| ***B65D 83/08*** | (2006.01) |

(Continued)

(52) U.S. Cl.
CPC ..... *A47K 10/423* (2013.01); *B65D 51/18* (2013.01); *B65D 51/26* (2013.01); *B65D 75/5877* (2013.01); *B65D 75/5894* (2013.01); *B65D 83/0805* (2013.01); *A47K 2010/3266* (2013.01);

(Continued)

(58) Field of Classification Search
CPC ..... B65D 83/0805; A47K 10/42
See application file for complete search history.

(56) References Cited

U.S. PATENT DOCUMENTS 3,265,242 A 8/1966 Davis
3,473,694 A * 10/1969 Dewhurst ..... B65D 83/0811 221/63

(Continued)

FOREIGN PATENT DOCUMENTS

CA 2818392 A1 5/2012
JP H06-292639 A 10/1994

(Continued)

OTHER PUBLICATIONS

Sep. 17, 2013 Written Opinion issued in International Patent Application No. PCT/JP2013/003637.

(Continued)

*Primary Examiner* — Timothy Waggoner
*Assistant Examiner* — Ayodeji Ojofeitimi
(74) *Attorney, Agent, or Firm* — Oliff PLC

(57) ABSTRACT

Exemplary embodiments of a wet wipe packaging body are designed to improve use quality as to press resistance application member against front surface of wet wipe stacked body at all times when bulk of wet wipe stacked body in bag body is reduced. Exemplary embodiments of the wet wipe packaging body include an outlet port frame body for wet wipes that pulled out from an opening portion provided in a bag body. A resistance application member, which is biased in direction in which resistance is applied to the wet wipe continuous body, is provided on an outlet port side of the outlet port frame body, and lower surface side of outlet port frame body is attached on an outer surface side of bag body so as to surround an opening portion of the bag body.

9 Claims, 7 Drawing Sheets

(51) Int. Cl.
*B65D 51/26* (2006.01)
*B65D 51/18* (2006.01)

(52) U.S. Cl.
CPC ..... *B65D 2251/0021* (2013.01); *B65D 2251/0028* (2013.01); *B65D 2251/0093* (2013.01)

(56) References Cited

U.S. PATENT DOCUMENTS

| | | | | |
|---|---|---|---|---|
| 4,848,575 | A * | 7/1989 | Nakamura | B65D 83/0805 206/449 |
| 6,910,579 | B2 * | 6/2005 | Reinke | A47K 10/421 206/494 |
| 8,210,393 | B1 | 7/2012 | Nasrallah | |
| 8,245,876 | B2 * | 8/2012 | Gehring | B65D 83/0811 221/37 |
| 2011/0303663 | A1 | 12/2011 | Bandoh et al. | |

FOREIGN PATENT DOCUMENTS

| | | | |
|---|---|---|---|
| JP | H09-132280 | A | 5/1997 |
| JP | 2004-196303 | A | 7/2004 |
| JP | 2004-331158 | A | 11/2004 |
| JP | 2010-116200 | A | 5/2010 |
| JP | 2010-173649 | A | 8/2010 |
| JP | 2011-173627 | A | 9/2011 |
| NO | 2005/023677 | A1 | 3/2005 |

OTHER PUBLICATIONS

Sep. 17, 2013 Search Report issued in International Patent Application No. PCT/JP2013/003637.
Jan. 5, 2017 Search Report issued in European Patent Application No. 13886848.4.

* cited by examiner

WET WIPE PACKAGING BODY

TECHNICAL FIELD

The present invention relates to a wet wipe packaging body in which a wet wipe stacked body is accommodated in a bag body.

BACKGROUND ART

Generally, wet wipe packaging bodies are used in such a way that a plurality of wet wipes is taken out one by one from a container that accommodates a wet wipe continuous body in which the wet wipes are connected in series to each other so as to be separable. Further, in recent years, not only bottle-type wet wipe packaging bodies, the accommodation container of which is cylindrical, but wet wipe packaging bodies, the accommodation container of which is formed into a bag shape such as a substantially rectangular shape or a pillow shape, have been widely used.

In such a bag-shaped wet wipe packaging body, a wet wipe stacked body formed by overlapping together portions other than the vicinity of the tip end of a wet wipe continuous body is accommodated in a bag body, and an opening portion for outwardly pulling out the wet wipe continuous body from the tip end side of the bag body is formed in one surface of the bag body (for example, Patent Documents 1 and 2).

On the other hand, wet wipe packaging bodies have also been known that are equipped with an outlet port frame body made of plastic or the like, the outlet port frame body having a resistance application hole, which has the function of applying a load to a wet wipe continuous body pulled out from the opening portion of a bag body to separately take out wet pipes one by one and holding the tip end of the wet wipe continuous body following the taken-out wet pipes, and a cover configured to be capable of opening and closing an outlet port (for example, Patent Document 3).

Patent Document 1: Japanese Patent Application Laid-open No. 2004-196303

Patent Document 2: Japanese Patent Application Laid-open No. 2010-173649

Patent Document 3: Japanese Patent Application Laid-open No. 2004-331158

SUMMARY OF THE INVENTION

In a wet wipe packaging body in which a wet wipe stacked body is stored in a bag body, the bulk of the wet wipe stacked body stored in the bag body in a folded state is gradually reduced as wet wipes are consumed.

Then, since the interval between the front surface of the wet wipe stacked body and a resistance application hole increases, the tensed state of the wet wipe continuous body when passing through the resistance application hole is loosened. Thus, resistance applied to the wet wipe continuous body is reduced, which makes the wet wipe continuous body easily pass through the resistance application hole.

This results in a problem in which a single wet wipe is not successfully separated from the wet wipe continuous body or a problem in which a plurality of wet wipes is taken out in a continuous form contrary to user's wishes due to a delay in timing for separating the wet wipes from the wet wipe continuous body. Further, there are cases where an outlet port is not reliably closed by a cover and thus the wet wipe continuous body is dried in the bag body to cause reduction in the use quality of the wet wipes.

In order to solve the problems described above, the present applicant has proposed and precedently filed a wet wipe packaging body in which a resistance application member having a resistance application hole is provided in an outlet port frame body in a biased state so as to be pressed against the front surface of a wet wipe stacked body and is configured to move to the side of the wet wipe stacked body by a biasing force as the bulk of the wet wipe stacked body is reduced when a wet wipe continuous body is pulled out from its tip end side (PCT/JP2013/001700). In this wet wipe packaging body, the interval between the front surface of the wet wipe stacked body and the resistance application hole does not increase even when wet wipes are consumed to gradually reduce the bulk of the wet wipe stacked body in a bag body, whereby reduction in resistance applied to the wet wipe continuous body can be prevented. As a result, a single wet wipe is successfully separated from the wet wipe continuous body, whereby a problem in which a plurality of wet wipes is taken out in a continuous form, a problem in which the wet wipe continuous body is dried in the bag body due to an improperly-closed cover, or the like can be prevented.

Conventionally, a wet wipe packaging body provided with an outlet port frame body having a resistance application hole and a cover as described above is generally configured such that the outlet port frame body is projected from the inner surface side of a bag body to the outer side of an opening portion and the upper surface side of the attachment portion of the outlet port frame body is adhered to the inner surface side of the bag body to attach the outlet port frame body. In this way, the bag body can be adhered to the outlet port frame body by heat sealing, which eliminates the use of an adhesive and brings about the advantage that the cost of the adhesive can be reduced. However, in a case in which the outlet port frame body is attached to the inner surface side of the bag body, it is necessary to make the outlet port frame body have a size and a shape enough to project from the opening portion of the bag body and thus necessary to prepare various outlet port frame bodies to suit differences in the shape and the size of opening portions of wet wipe packaging bodies, which gives rise to the problem in that costs for manufacturing the many outlet port frame bodies and complicated works and costs for managing and storing different components are incurred. In addition, in the attachment of the outlet port frame body to the bag body, the outlet port frame body is inserted in the opening portion of the bag body from the inner surface side of the bag body. However, the portion of the outlet port frame body projecting outwardly from the bag body is formed to have substantially the same size and the shape as those of the opening portion of the bag body, which gives rise to the problem in that the attachment operation requires precision and carefulness.

The present invention has been made in order to solve the problems described above and has an object of providing a wet wipe packaging body that is inexpensive while offering excellent use quality, the wet wipe packaging body attempting to improve the use quality in such a way as to press a resistance application member against the front surface of a wet wipe stacked body at all times when wet wipes are consumed to reduce the bulk of the wet wipe stacked body as well as allowing the use of a general-purpose member without requiring the preparation of many outlet port frame bodies to suit differences in the shape and the size of the opening portion of a bag body.

In order to achieve the above object, the present invention provides a wet wipe packaging body including a wet wipe stacked body obtained by folding a wet wipe continuous body in which a plurality of wet wipes are connected to each other so as to be separable, a bag body in which the wet wipe stacked body is accommodated, an opening portion provided in the bag body and used to take out the wet wipes, an outlet port frame body with an outlet port used to outwardly take out the wet wipes pulled out from the opening portion, and a cover body attached to the outlet port frame body and capable of opening and closing the outlet port, wherein a resistance application hole is provided on an outlet port side of the outlet port frame body, the resistance application member, which is biased in a direction in which resistance is applied to the wet wipe continuous body, is provided such that at least a part thereof is allowed to enter the bag body via the opening portion of the bag body, and the outlet port frame body is attached with a lower surface side thereof bonded on an outer surface side of the bag body so as to surround the opening portion of the bag body with the outlet port.

In the wet wipe packaging body of the present invention, the opening portion of the bag body may be tightly closed by a sealing surface of a flap seal bonded to an outer front surface of the bag body, the flap seal having the sealing surface used to seal the opening portion and a picking-up piece for peeling provided to be connected to a circumference of the sealing surface and formed to be folded back on an upper surface side of the sealing surface. Further, in the wet wipe packaging body of the present invention, the resistance application member may be configured such that one end thereof is supported by the outlet port frame body and the other end thereof on a free end side is pressed against a front surface of the wet wipe stacked body by a biasing force, and the resistance application member may be integrally formed with the outlet port frame body.

According to the present invention, the resistance application member is pressed against the front surface of the wet wipe stacked body in the bag body at all times by a biasing force. Therefore, even when the wet wipes are consumed to gradually reduce the bulk of the wet wipe stacked body in the bag body, the interval between the front surface of the wet wipe stacked body and the resistance application hole provided in the resistance application member does not greatly increase and resistance applied to the wet wipe continuous body is not reduced. Therefore, the wet wipe continuous body is successfully separated, and thus use quality can be improved. In addition, in the wet wipe packaging body of the present invention, the outlet port frame body is attached with the lower surface side bonded on the outer surface side of the bag body. Therefore, provided that the outlet port is formed to have a size and a shape enough to surround the opening portion of the bag body, it is not necessary to prepare many outlet port frame bodies to suit the shape and the size of the opening portion depending on differences in the type of the wet wipe packaging body but is possible to use a general-purpose member. Moreover, it is easy to perform an attachment operation. Therefore, the present invention produces an advantage such as offering the wet wipe packaging body at low cost while further improving use quality.

DESCRIPTION OF THE EMBODIMENTS

A description will be given of an embodiment of the present invention with reference to the drawings.

FIGS. 1 to 6 show a wet wipe packaging body according to an embodiment of the present invention.

Figure 1:
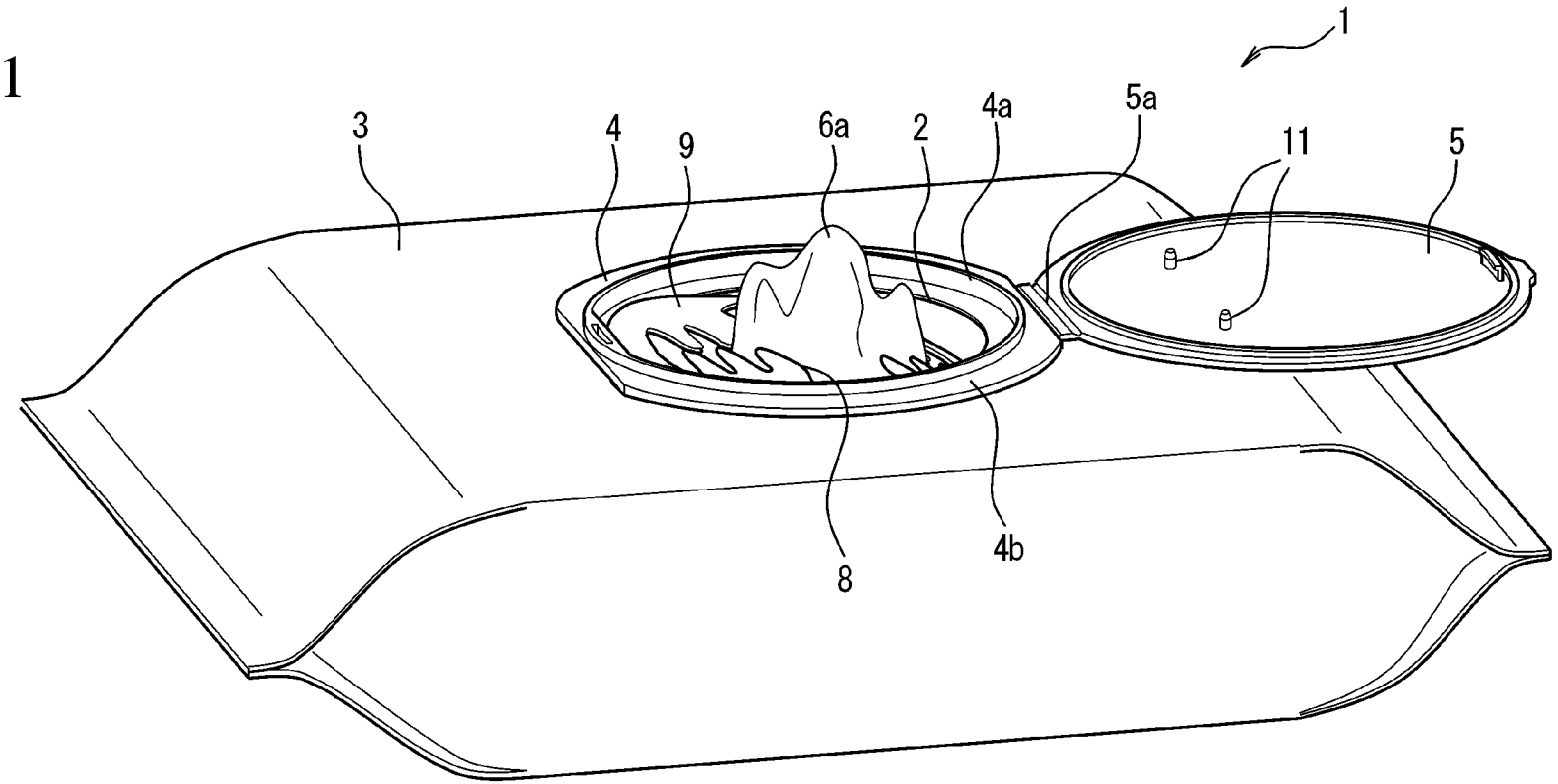
FIG. 1 is an external perspective view of a wet wipe packaging body that is in use according to an embodiment of the present invention.

FIG. 1 is an external perspective view of a wet wipe packaging body 1 that is in use. A bag body 3 having an opening portion 2 at the central area of its one surface is sealed at its open area other than the opening portion 2 by heat sealing or the like using a flexible plastic film or the like having air-tightness and is formed into, for example, a pillow-like bag shape. The bag body 3 may be made of a plastic film or the like having a single-layered structure but may be made of a layered film or the like having a plurality of layers. In the bag body 3, a wet wipe stacked body 6*b* is accommodated (FIG. 2).

The opening portion 2 is formed to be opened at the central area of one of the largest surfaces of the bag body 3 to outwardly pull a tip end portion 6*a* of a wet wipe continuous body 6. A ring-shaped outlet port frame body 4 made of a plastic material or the like having rigidity is attached to the opening portion 2. Further, a cover body 5 with which the opening portion 2 is openable and closeable from an outside is openably and closably connected to the outlet port frame body 4. The cover body 5 is, when being closed, fitted over the circumference of a ring-shaped outer circumferential portion 4*a* of the outlet port frame body 4 to close an outlet port formed on the inner side of the outer circumferential portion 4*a* of the outlet port frame body 4. The outlet port frame body 4 and the cover body 5 are integrally molded with each other by, for example, a thermoplastic resin such as polyethylene and polypropylene via a hinge portion 5*a* serving as a shaft for rotational movements. However, the outlet port frame body 4 and the cover body 5 may be configured to be formed as separate bodies and combined with each other.

The outlet port frame body 4 of the embodiment is formed into, for example, a ring shape such as a circular or elliptical shape. However, other ring shapes may be used. Further, a flange-shaped portion 4*b* is formed to project from the circumference of the bottom portion, and the lower surface side of the flange-shaped portion 4*b* of the outlet port member 4 is air-tightly bonded by a hot melt adhesive or other adhesives to the outer front surface of the bag body 3 so as to surround the periphery of the opening portion 2 at a position away from the outer circumference of the opening portion 2.

Figure 2:
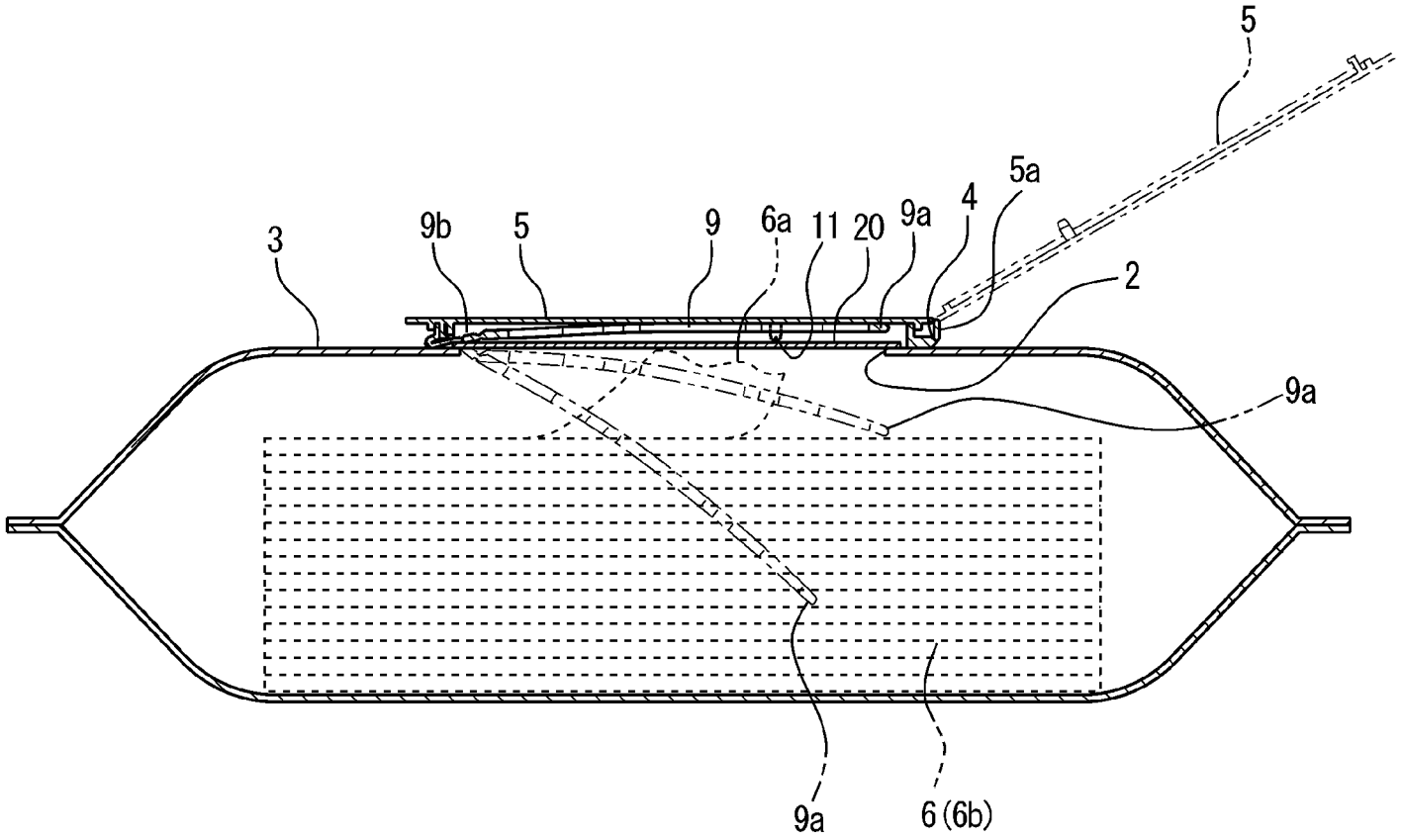
FIG. 2 is a vertical cross-sectional view of the lateral surface side of the wet wipe packaging body before being used according to the embodiment of the present invention.

FIG. 2 is a vertical cross-sectional view of the lateral surface side of the wet wipe packaging body. The wet wipe stacked body 6*b* accommodated in the bag body 3 is one obtained by folding the wet wipe continuous body 6 in which adjacent wet wipes as a plurality of independent sheet wet wipes are overlapped with each other at their ends, and is folded and stacked together by so-called Z-folding, W-folding, WZ-folding, or the like.

Thus, when the tip end portion 6*a* of the wet wipe continuous body 6 is outwardly pulled out from the opening portion 2, the rear end of the pulled-out wet wipe continuous body 6 is not brought into contact with the tip end of the wet wipe continuous body 6 stacked in the next place, whereby a single wet wipe is separated from the wet wipe continuous body 6.

The wet wipe continuous body 6 is base cloth impregnated with a medicine or the like. A paper, woven cloth, non-woven cloth, or the like made of, for example, synthetic fibers or natural fibers is used as a base cloth material, but the wet wipe continuous body 6 may be made of other materials. Further, examples of a medical solution or the like include an alcohol, water, or their mixtures. However, a perfume, an antibacterial agent, a deodorizing agent, a surfactant, an antiseptic, a pigment, a defoaming agent, an antioxidant, a clarifier, a solubilizing agent, or the like may be blended together, or other medical solutions or the like may be used.

As described above, the cover body 5 is rotatably connected about the hinge portion 5*a* to the outlet port frame body 4 adhered to the outer front surface of the bag body 3 so as to surround the opening portion 2 of the bag body 3. FIG. 2 shows a state, in which the cover body 5 is closed to close the outlet port frame body 4, by solid lines and shows a state, in which the cover body 5 is opened, by chain double-dashed lines.

The opening portion 2 of the bag body 3 is tightly closed by a flap seal 20 bonded to the outer surface of the bag body 3. As specifically shown in FIG. 3 that is an exploded perspective view of the wet wipe packaging body 1, the flap seal 20 is configured to be folded in two by a folding back portion 21 and doubly overlapped with each other in a vertical direction. A sealing surface 22 on the lower side of the flap seal 20 is formed to have a size at which the entire opening portion 2 can be tightly closed, a picking-up piece 23 on the upper side is formed to be narrower than the sealing surface 22 and configured as a picking-up portion to peel the sealing surface 22. Further, an end 24 of the picking-up piece 23 at a position away from the folding back portion 21 is formed to slightly project outward from the outer circumference of the sealing surface 22 so as to be easily picked up by fingers.

The lower surface (rear surface) of the sealing surface 22 of the flap seal 20 thus configured is bonded to the front surface of the bag body 3, and the opening portion 2 of the wet wipe packaging body that is not in use is tightly closed by the flap seal 20 as shown in FIG. 2. This results in advantages such as preventing the drying of the wet wipe stacked body 6*b* in the bag body 3 even in a case in which the wet wipe packaging body is preserved for a long time and making an adhesive that bonds the outlet port frame body 4 to the bag body 3 be free from the adverse effect of vapors of medicine or the like generated by the wet wipe stacked body 6*b*. Note that the flap seal 20 is not necessarily the one in which the sealing surface 22 and the picking-up piece 23 are integrally formed with each other as described in the embodiment. For example, the flap seal 20 may have a configuration in which a sealing surface and a picking-up piece as separate bodies are joined together by the folding back portion 21, or the like.

Figure 3:
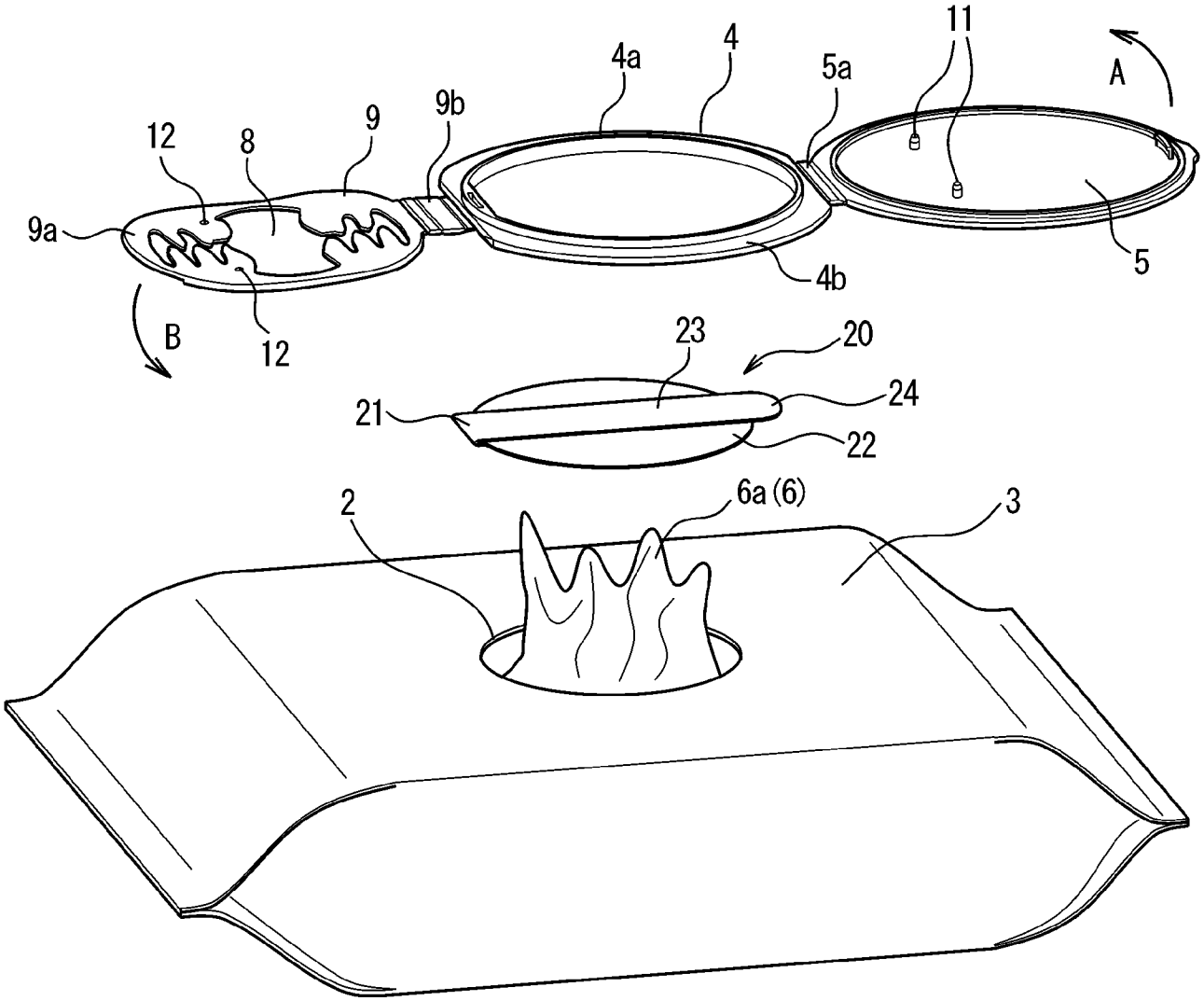
FIG. 3 is an exploded perspective view of the wet wipe packaging body according to the embodiment of the present invention.

In the inner region of the outlet port frame body 4, a resistance application member 9 having a resistance application hole 8 for applying resistance to the passing-through wet wipe continuous body 6 is arranged (FIGS. 1 and 3). The resistance application hole 8 is well known. When the wet wipe continuous body 6 is pulled outwardly from the bag body 3, frictional resistance is applied to the wet wipe continuous body 6, which passes through the inner side of the resistance application hole 8, from the resistance application hole 8. Thus, the wet wipe continuous body 6 is separated at its separation allowing portion at a position at which the wet wipe continuous body 6 has just passed through the resistance application hole 8, and the wet wipe continuous body 6, which is positioned ahead of the separation allowing portion and covers its area from a tip end portion 6*a* to the separation allowing portion, is taken out as a single wet wipe. Then, the outermost tip end portion of the wet wipe continuous body 6 left behind the taken-out wet wipe is held in a state of slightly outwardly projecting from the resistance application hole 8. Note that the resistance application hole 8 has various known shapes and may employ any of the shapes. Further, the resistance application hole 8 may have any shape other than the known ones so long as resistance, by which a single wet wipe can be separated from the wet wipe continuous body 6 and the tip end portion of the wet wipe continuous body 6 in the next place can be held, can be applied to the wet wipe continuous body.

The resistance application member 9 having the resistance application hole 8 as described above is formed to be integrated with or separated from the outlet port frame body 4 and brought into a so-called cantilevered state in which only one end side of the resistance application member 9 is fixed to the outlet port frame body 4. Further, the side of a free end 9*a* of the resistance application member 9 is biased so as to enter the bag body 3 via the opening portion 2. In the embodiment, the resistance application member 9 has a biasing force generated from its own elasticity. However, an elastic member or the like for applying a biasing force to the resistance application member 9 may be separately provided.

With the configuration described above, provided that the flap seal 20 has been removed as shown in FIG. 1, the side of the free end 9*a* of the resistance application member 9 moves downward from a position indicated by the chain double-dashed lines to a position indicated by dashed lines in the bag body 3 due to the biasing force, in accordance with the reduction amount of the bulk of the wet wipe stacked body 6*b*, as shown in FIG. 2. Therefore, even if the bulk of the wet wipe stacked body 6*b* is reduced, the resistance application member 9 is continuously pressed against the front surface of the wet wipe stacked body 6*b*. Note that FIG. 2 shows a state in which the flap seal 20 has not been removed, but the above description on the movements of the resistance application member 9 is given assuming that the flap seal 20 has been removed.

In the way described above, the resistance application member 9 is tilted relative to the pulling-out direction of the wet wipe continuous body 6 in a state in which the bulk of the wet wipe stacked body 6*b* is reduced. As a result, strong frictional resistance is applied to the wet wipe continuous body 6 from the resistance application hole 8, whereby a leading wet wipe of the wet wipe continuous body 6 can be separated and pulled out at an appropriate position.

As shown in, for example, FIG. 3, the resistance application member 9 described above is integrally molded with the outlet port frame body 4 in a state of projecting from the outlet port frame body 4 in a direction opposite to the cover body 5 by 180 degrees. However, the resistance application member 9 may be made of a member different from the outlet port frame body 4 and attached to the outlet port frame body 4 by a method such as engagement. The cover body 5 is rotated in a direction indicated by an arrow A in FIG. 3 and used so as to make the outlet port of the outlet port forming member 4 openable and closeable. On the other hand, the resistance application member 9 is rotated in a direction indicated by an arrow B to fold a joining portion 9*b* between the resistance application member 9 and the outlet port frame body 4 and arranged from the side of the bottom portion of the outlet port frame body 4 so as to be positioned on the inner side (taking-out side) of the outlet port frame body 4. As a result, the biasing force is generated in the resistance application member 9 in a direction opposite to the arrow B.

Accordingly, when the outlet port frame body 4 is attached to the bag body 3 to be assembled for manufacturing, there is a likelihood that the resistance application member 9 pops up from the outlet port frame body 4 to cause a difficulty in smoothly assembling the outlet port frame body 4. Therefore, in the embodiment, short pin-shaped holding bodies 11 capable of freely engaging with the resistance application member 9 and holding the resistance application member 9 in a region inside the outlet port frame body 4 are provided projectingly from the rear surface of the cover body 5, and engagement holes 12 in which the holding bodies 11 are elastically fitted are provided on the side of the resistance application member 9 to solve the above problem. The holding bodies 11 can be integrally molded with the cover body 5. In addition, the engagement force of the holding bodies 11 to the engagement holes 12 is further secured if the head portions of the holding bodies 11 are slotted.

As shown in FIG. 2, when the holding bodies 11 projecting from the cover body 5 are fitted in the engagement holes 12 formed in the resistance application member 9, the resistance application member 9 is attracted to the vicinity of the cover body 5 and held by the cover body 5. With the configuration described above, hindrance in the adhering operation of the outlet port frame body 4 due to the downwardly-projecting resistance application member 9 is prevented when the outlet port frame body 4 is adhered to the bag body 3, and thus the attachment can be smoothly performed. The state remains until the cover body 5 is first opened after the manufacturing of the wet wipe packaging body 1. Then, once the cover body 5 is opened, the holding bodies 11 are disengaged from the engagement holes 12 to release a state in which the resistance application member 9 is held by the holding bodies 11.

Figure 4:
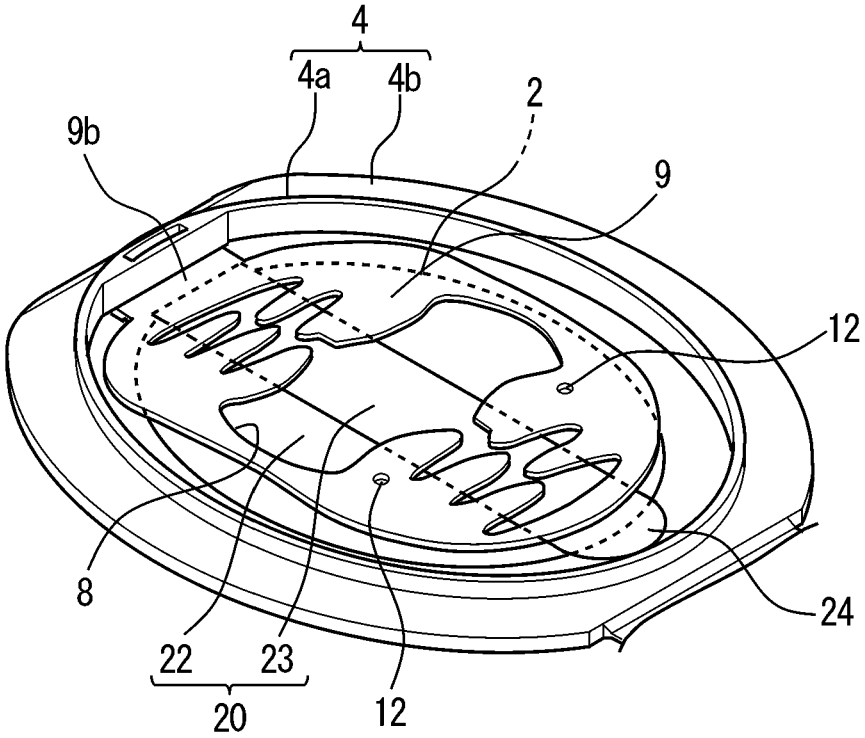
FIG. 4 is a perspective view showing the state of the inner side of an outlet port frame body with its cover body opened in the wet wipe packaging body according to the embodiment of the present invention.
Figure 5:
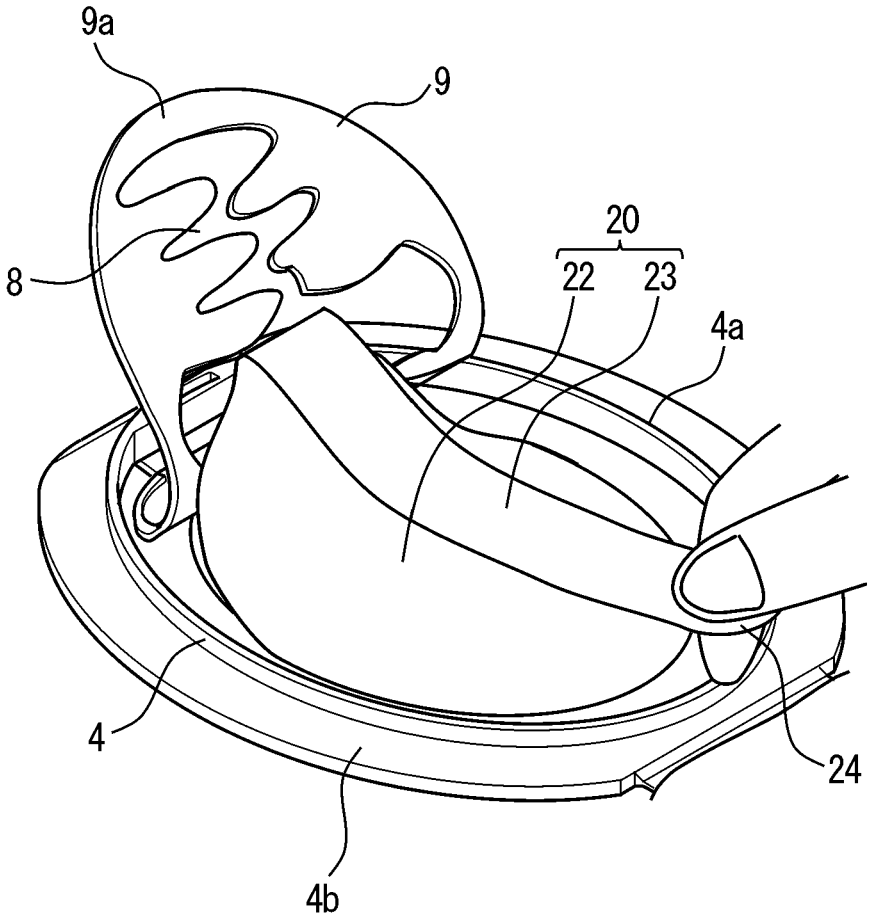
FIG. 5 is a perspective view of the outlet port frame body, showing a state in which a flap seal is being removed from the wet wipe packaging body according to the embodiment of the present invention.
Figure 6:
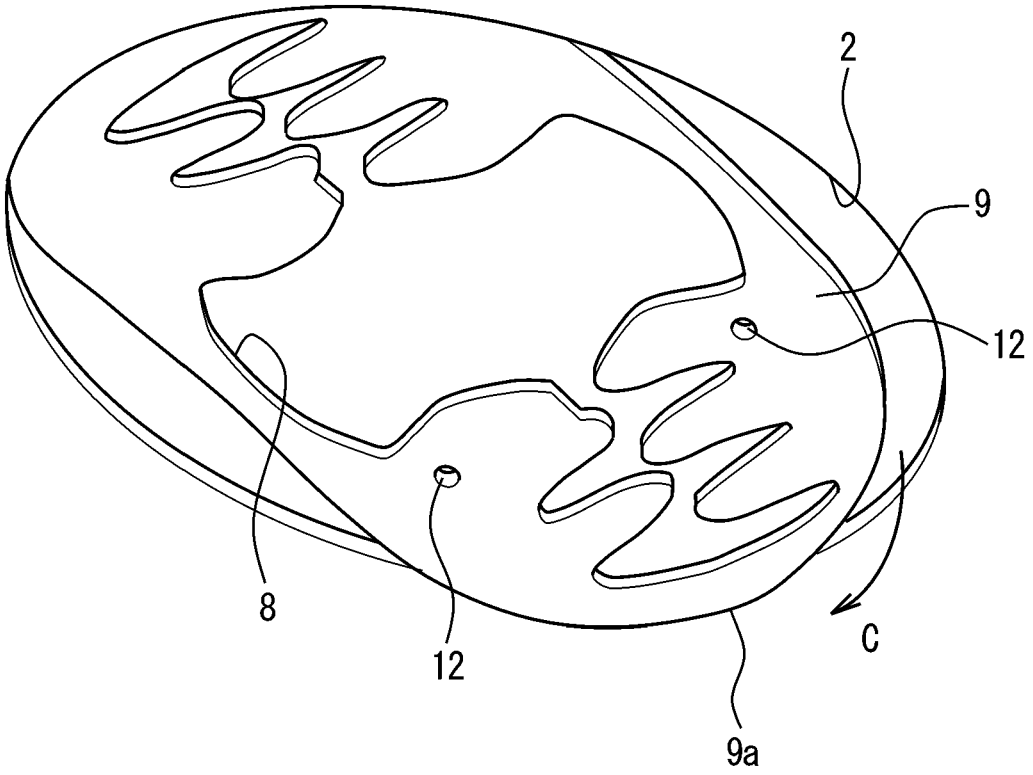
FIG. 6 is a perspective view of a resistance application member when seen from the inner side of a bag body in a state in which the wet wipe packaging body according to the embodiment of the present invention is in use.

FIG. 4 shows a state of the inner side of the outlet port frame body 4 when the cover body 5 is opened after the outlet port frame body 4 is attached to the outer surface side of the bag body 3 of which the opening portion 2 is tightly closed by the flap seal 20. Since the state in which the resistance application member 9 is held by the holding bodies 11 is released at this time, the resistance application member 9 is pressed against the side of the flap seal 20 by the biasing force. Therefore, in order to peel the flap seal 20 to be ready for the use of the wet wipes, the side of the free end 9*a* of the resistance application member 9 is lifted upward, the end 24 of the picking-up piece 23 of the flap seal 2Q is picked up and pulled by fingers to peel the sealing surface 22 from the bag body 3, and the flap seal 20 is removed from the inner side of the outlet port frame body 4 as shown in FIG. 5. In this way, the wet wipe packaging body 1 can be put into the state ready for the use of the wet wipes shown in FIG. 1. FIG. 6 shows the state of the resistance application member 9 when seen from the inner side of the bag body 3 at this time. Here, the side of the free end 9*a* of the resistance application member 9 biased toward the inner side of the bag body 3 (in a direction indicated by an arrow C) enters the bag body 3 via the opening portion 2 and is pressed against the front surface of the wet wipe stacked body 6*b* not shown.

Note that the holding bodies 11 are not necessarily the short pin-shaped members formed to project from the rear side of the cover body 5 so long as they are structured to be capable of holding the resistance application member 9, but the holding bodies 11 may have any shape and structure so long as they can appropriately hold the resistance application member 9 on the inner side of the outlet port frame body 4. In addition, the holding bodies 11 are not limited to those configured to be disengaged from the engagement holes 12 of the resistance application member 9 when the cover body 5 is opened, but the holding bodies 11 may be those configured to be disengaged from the resistance application member 9 by hand after the cover body 5 is opened. Moreover, the holding bodies 11 are not limited to those provided on the rear surface side of the cover body 5 but may be those provided on the outlet port frame body 4 or the like.

The above embodiment shows an example in which the opening portion 2 of the bag body 3 is configured to be tightly closed by the flap seal 20 and the flap seal 20 is peeled in use. However, the opening portion 2 may be configured to be tightly closed by a seal in a half-cut state and opened by pressing or peeling a half-cut portion to or from the bag body 3 for use. Further, the opening portion 2 can also be configured such that the outlet port of the outlet port frame body 4 is tightly closed by a pull-top cover instead of the flap seal and the pull-top cover is pulled out to open the opening portion 2 in use.

Figure 7A:
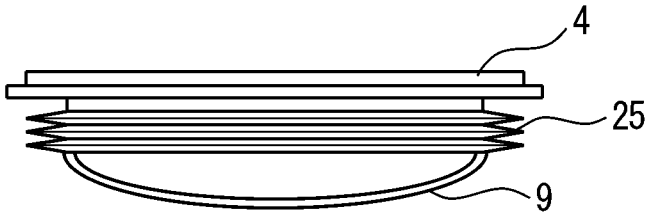
FIGS. 7A to 7D are schematic views of the lateral surfaces of essential portions showing different attachment states of the resistance application member.
Figure 7B:
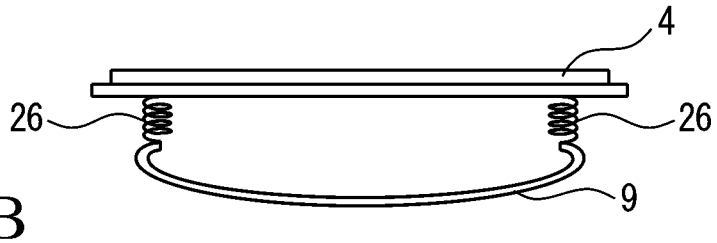
Figure 7C:
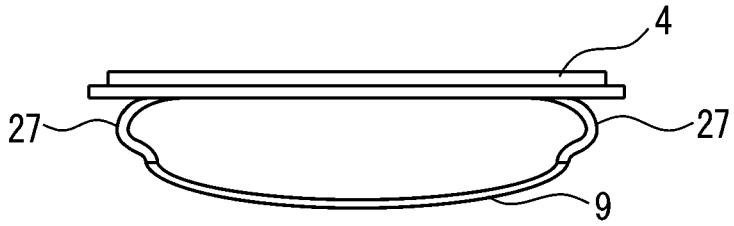
Figure 7D:
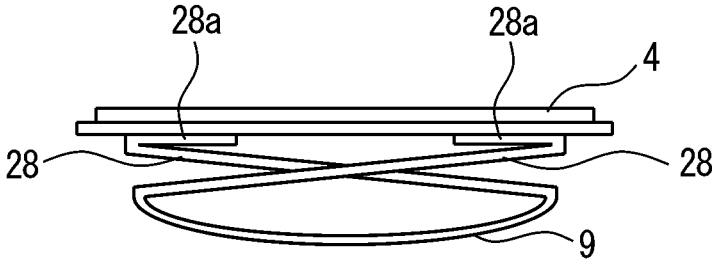

Further, the above embodiment shows a case in which the one end side of the resistance application member 9 is fixed to the outlet port frame body 4 to bring the resistance application member 9 into a cantilevered state. However, as shown in FIGS. 7A to 7D, the resistance application member 9 may be brought into a so-called both-end support state in which the both ends of the resistance application member 9 are fixed to the outlet port frame body 4. As shown in, for example, FIG. 7A, the both ends of the resistance application member 9 may be attached to a pleated portion 25 fixed to the outlet port frame body 4 such that the resistance application member 9 is biased by the restoration force of the compressed pleated portion 25. Further, as shown in FIG. 7B, the both ends of the resistance application member 9 may be respectively fixed to the first ends of springs 26, second ends of which are fixed to the outlet port frame body 4, such that the resistance application member 9 is biased by the restoration force of the compressed springs 26. Further, as shown in FIG. 7C, the resistance application member 9 may be fixed to elastic bodies 27 instead of springs such that the resistance application member 9 is biased by the restoration force of the elastic bodies 27 compressed so as to curve. Further, as shown in FIG. 7D, rod-shaped supporting bodies 28 made of elastic bodies or the like may be attached to the outlet port frame body 4 at their folded ends on one side and fixed to the resistance application member 9 at their ends on the other side such that the resistance application member 9 is biased by a restoration force generated when the compressed folded portions 28*a* are compressed. Examples of the above elastic bodies include, but not limited to, rubber, plastic, or the like so long as they are made of materials having elasticity. However, rubber and plastic are generally preferable. Note that in a case in which the resistance application member 9 is brought into a both-end support state as shown in FIGS. 7A to 7D, the opening portion 2 of the bag body 3 is preferably configured to be tightly closed by a seal in a half-cut state and opened by pressing a half-cut portion into the bag body 3, or the opening portion 2 is preferably configured such that the outlet port of the outlet port frame body 4 is tightly closed by a pull-top cover and the pull-top cover is pulled out to open the opening portion 2.

The present invention is not limited to the above embodiment but includes all modes in the concepts of the inventions of the claims.

The invention claimed is:

1. A wet wipe packaging body comprising:

a bag body that stores a wet wipe stacked body and comprises an opening portion, the wet wipe stacked body comprising a plurality of wet wipes that is capable of separating;

an outlet member that comprises an outlet port used to outwardly take out a wet wipe of the wet wipes pulled out from the opening portion;

a cover connected to the outlet member and capable of opening and closing the outlet port;

a resistance member connected to the outlet member and is capable of biasing the wet wipe stacked body: and a holding member that holds the resistance member outside of the bag body.

2. The wet wipe packaging body of claim 1, wherein the holding member is provided with the cover.

3. The wet wipe packaging body of claim 1, wherein the resistance member releases from the holding member in accordance with opening the outlet port by the cover.

4. The wet wipe packaging body of claim 3, wherein at least one of the resistance member positions inside of the bag body by using the opening portion.

5. The wet wipe packaging body of claim 1, the resistance member comprises a resistance application hole member to apply resistance force to the wet wipe.

6. A resistance application method to bias at least one of wet wipes, the method comprising the steps of:

closing an opening portion of a bag body that stores a wet wipe stacked body by a cover, the cover being capable of holding a resistance member outside of the bag body when the cover closes the opening portion; and biasing at least one of the wet wipes by the resistance member in accordance with opening of the opening portion by the cover, the wet wipe stacked body comprising the wet wipes that is capable of separating.

7. The resistance application method of claim 6, wherein the resistance member biases at least one of the wet wipes at below of the opening portion.

8. The resistance application method of claim 6, wherein the resistance member applies resistance to a wet wipe of the wet wipes by using a resistance application hole member provided with the resistance member.

9. The resistance application method of claim 6, wherein the resistance member does not bias the wet wipes when the resistance member is held by the cover.

* * * * *